United States Patent [19]

Oka

[11] 4,280,299

[45] Jul. 28, 1981

[54] WHISTLE

[75] Inventor: Toshio Oka, Osaka, Japan

[73] Assignee: Zenzaburo Kawanishi, Osaka, Japan

[21] Appl. No.: 92,495

[22] Filed: Nov. 8, 1979

[30] Foreign Application Priority Data

May 10, 1979 [JP] Japan ..... 54-62776[U]

[51] Int. Cl.[3] ..... A63H 5/00

[52] U.S. Cl. ..... 46/179

[58] Field of Search ..... 46/179, 178, 175 R, 46/180, 181

[56] References Cited

U.S. PATENT DOCUMENTS

| | | | |
|---|---|---|---|
| 1,383,878 | 7/1921 | Taylor | 46/179 |
| 2,505,141 | 4/1950 | Pitts | 46/179 |

*Primary Examiner*—Robert Peshock

*Assistant Examiner*—Michael J. Foycik, Jr.

*Attorney, Agent, or Firm*—Wenderoth, Lind & Ponack

[57] ABSTRACT

A whistle including a mouthpiece adapted to be fit on a body. The body has three cavities different in depth. A protuberance provided in the chamber at the bottom of the mouthpiece is adapted to cover one of the cavities. Different pitches of the sound can be produced according to which cavity is covered.

1 Claim, 6 Drawing Figures

WHISTLE

This invention pertains to an improved whistle, and more particularly to a whistle to be used by an umpire in volleyball, basketball, etc.

When volleyball, basketball or the like is simultaneously played in two or more courts placed in juxtaposition with each other, it is essential that umpires use whistles which have different pitches of the sound so that players playing a match in one court will not be confused by the sound of a whistle blown by an umpire for another court.

It is an object of the present invention to provide a whistle capable of producing different tones as the occasion demands, so as to obviate the necessity of using different whistles each capable of producing a single tone peculiar thereto.

With this object in view which will become apparent from the following detailed description, the present invention will be more clearly understood in connection with the accompanying drawings, in which.

Figure 1:
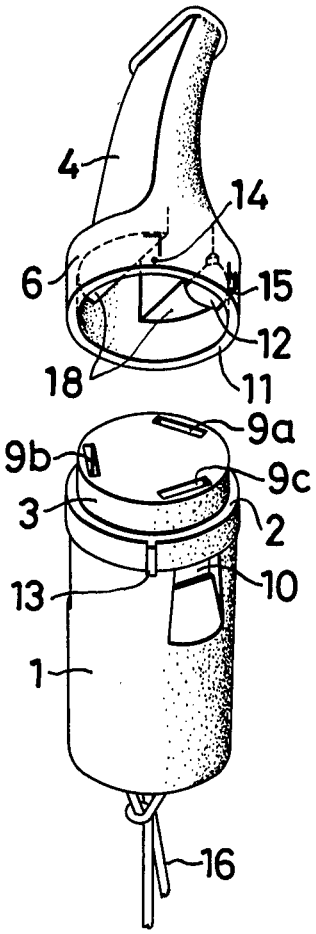
FIG. 1 is an exploded perspective view of a whistle according to the present invention.
Figure 2:
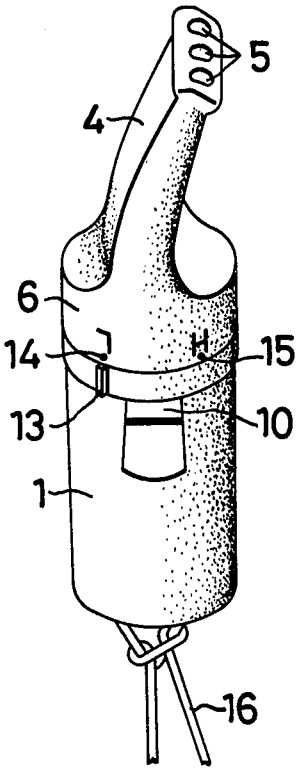
FIG. 2 is a perspective view thereof with the mouthpiece coupled with the body of the whistle.

Referring now to the drawings, a whistle in accordance with the present invention includes a body 1, which has a top end portion having a reduced diameter with an annular shoulder 2 and a cylindrical neck 3. Adapted to be fit on the top end portion of the body 1 is a mouthpiece 4, which is provided with three axially extending holes 5, through which breath is forced into a recess 17 provided in the mid portion of the mouthpiece 4.

A tubular flange 6 is formed at the bottom of the mouthpiece 4 so that the passageway for the breath is enlarged from the recess 17 to a cylindrical chamber 7 and two shoulders 18 are formed at the bottom of the cylindrical chamber 7. A downward protuberance 12 is provided on one of the shoulders 18.

The cylindrical chamber 7 has an inside diameter substantially equal to the outside diameter of the cylindrical neck 3. When the mouthpiece 4 is fitted on the body 1, the tubular flange 6 will engage the cylindrical neck 3 tightly enough so that air will not escape. The cylindrical neck 3 has a height such that, when the annular base 11 of the mouthpiece 4 touches the annular shoulder 2, the lower surface of the protuberance 12 comes in contact with the top surface of the cylindrical neck 3.

The body 1 is provided with three cavities **8*a*, 8*b* and 8*c* respectively having different depths and extending parallel with, and at the same distance from, the axis of the tubular body 1. Communication from the chamber 7 to the cavities 8*a*, 8*b* and 8*c* is provided by slits 9*a*, 9*b* and 9*c*, respectively, passing through the upper part of the body 1. In the upper part of each of the cavities 8*a*, 8*b* and 8*c*, an aperture 10 is provided through the side wall of the body 1** for escape of air.

The protuberance 12, which is provided eccentrically with respect to the center of the chamber 7, is adapted to cover one of the slits **9*a*, 9*b* and 9*c* or to cover none of them as the mouthpiece 4 is turned with respect to the body 1**.

The outside surface of the tubular flange 6 has marks 14 and 15 accompanied by letters "L" and "H" respectively, while the cylindrical side wall of the body 1 has a mark 13.

Figure 3:
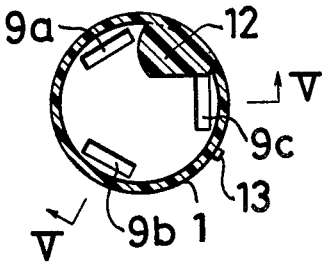
FIG. 3 is a transverse sectional view thereof with none of the three cavities covered.

FIG. 3 shows the whistle with the mark 13 set at the mark 14 or the letter L. In this case, the protuberance 12 covers none of the slits **9*a*, 9*b* and 9*c*** and, therefore, the whistle produces a mixture of three pitches of the sound.

Figure 4:
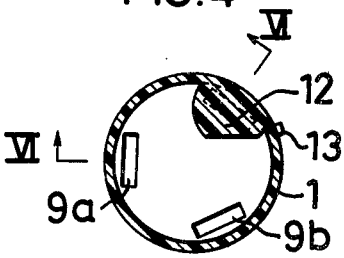
FIG. 4 is a transverse sectional view thereof with the deepest cavity covered.
Figure 5:
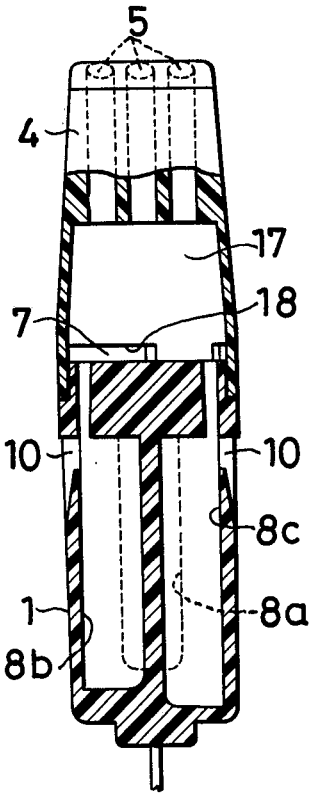
FIG. 5 is a vertical sectional view thereof taken along the line V—V of FIG. 3.
Figure 6:
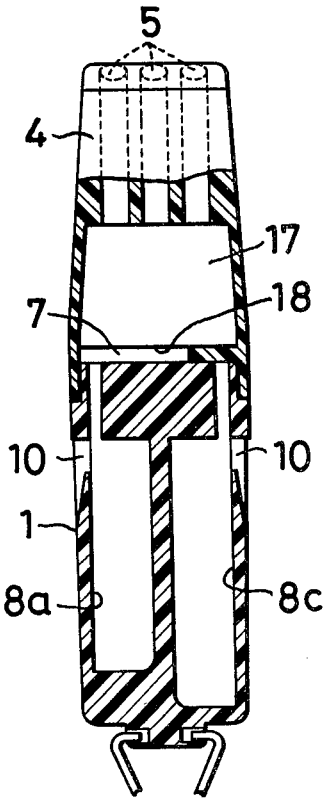
FIG. 6 is a vertical sectional view thereof taken along the line VI—VI of FIG. 4.

FIG. 4 shows the whistle with the mark 13 set at the mark 15. In this case, the protuberance 12 covers the slit **9*c* for the cavity 8*c* which is the deepest of the three cavities. As a consequence, a mixture of middle- and high-pitched sounds is produced by the cavities 8*a* and 8*b*** which are shallow and intermediate in depth, respectively.

In this manner, the whistle in accordance with this embodiment can produce four different tones, i.e., a mixture of middle- and high-pitched sounds, a mixture of high- and low-pitched sounds, a mixture of low- and middle-pitched sounds, and a mixture of low-, middle- and high-pitched sounds.

The number and size of holes 5 and cavities **8*a*, 8*b* and 8*c*** may be varied to suit requirements.

A string 16 connected to the bottom of the body 1 is adapted to be worn about the neck of a person who uses the whistle.

While I have disclosed a preferred embodiment of the present invention, it is to be understood that this embodiment is given by example only and not in a limiting sense, the scope of the present invention being determined by the claim.

What I claim is:

1. A whistle, comprising:

a body having a plurality of separate axially extending cavities each respectively having different depths and having an opening opening out of the top of said body and further having an aperture midway of their length; and a mouthpiece having at least one hole extending generally axially out of one end of said mouthpiece, the other end of said hole having a size covering the top of said body for communicating with said openings in the top of said body, said mouthpiece being fitted in air tight engagement on said body, said mouthpiece having a protuberance therein projecting toward the top of said body and engaging the top of said body when said mouthpiece is fitted on said body, said protuberance extending in the circumferential direction of said mouthpiece a distance sufficient to cover only one of said openings and less than the distance between said openings, whereby said mouthpiece can be positioned on said body with said protuberance covering none of said openings or covering one of said openings so that air blown into said mouthpiece will produce one of four sounds from flowing through all three of said cavities or through only two of them at a time.

* * * * *